US008015640B2

(12) United States Patent
Sun

(10) Patent No.: US 8,015,640 B2
(45) Date of Patent: Sep. 13, 2011

(54) MULTI-POSITION CERVICAL PILLOW AND AN ADJUSTABLE PILLOW SET THEREOF

(76) Inventor: Xi Sun, Overland Park, KS (US)

( * ) Notice: Subject to any disclaimer, the term of this patent is extended or adjusted under 35 U.S.C. 154(b) by 59 days.

(21) Appl. No.: 12/573,518

(22) Filed: Oct. 5, 2009

(65) Prior Publication Data

US 2011/0078860 A1 Apr. 7, 2011

(51) Int. Cl.
*A47C 20/00* (2006.01)

(52) U.S. Cl. ..... 5/640; 5/636

(58) Field of Classification Search ..... 5/636, 640, 5/632, 638, 643, 637
See application file for complete search history.

(56) References Cited

U.S. PATENT DOCUMENTS

| | | | | | |
|---|---|---|---|---|---|
| 3,775,785 | A | | 12/1973 | Mittondorf | |
| D293,755 | S | * | 1/1988 | Murphy | D6/601 |
| 4,756,090 | A | | 7/1988 | Pedrow | |
| 4,832,007 | A | * | 5/1989 | Davis et al. | 5/636 |
| 4,899,405 | A | * | 2/1990 | Rothbard | 5/636 |
| 4,914,763 | A | | 4/1990 | Clark | |
| 4,916,765 | A | * | 4/1990 | Castronovo, Jr. | 5/640 |
| 5,016,303 | A | | 5/1991 | Tanaka | |
| 5,163,194 | A | | 11/1992 | Dixon | |
| 5,537,703 | A | | 7/1996 | Launder | |
| 5,732,427 | A | | 3/1998 | Parnham | |
| 5,926,879 | A | | 7/1999 | Davis | |
| 5,926,880 | A | | 7/1999 | Sramek | |
| 5,937,460 | A | | 8/1999 | Humphries | |
| 5,953,777 | A | | 9/1999 | Buck | |
| 5,987,676 | A | | 11/1999 | Littleford | |
| 6,006,380 | A | | 12/1999 | Sramek | |
| 6,151,733 | A | | 11/2000 | Takashima | |
| 6,327,725 | B1 | | 12/2001 | Veilleux | |
| 6,345,401 | B1 | | 2/2002 | Frydman | |
| 6,895,619 | B1 | | 5/2005 | Lee | |
| 6,981,288 | B1 | | 1/2006 | Hu | |
| 7,013,512 | B1 | | 3/2006 | Hsu | |
| 2006/0236459 | A1 | * | 10/2006 | Lavin et al. | 5/636 |
| 2008/0022459 | A1 | | 1/2008 | Cho | |
| 2008/0086819 | A1 | * | 4/2008 | Valero Pavia | 5/640 |
| 2008/0216242 | A1 | * | 9/2008 | Reeves | 5/636 |
| 2009/0025145 | A1 | * | 1/2009 | Tuffin et al. | 5/636 |
| 2010/0281617 | A1 | * | 11/2010 | Brun | 5/632 |

* cited by examiner

*Primary Examiner* — Robert G Santos
*Assistant Examiner* — Brittany Wilson

(57) ABSTRACT

The present invention pertains to a multi-position cervical pillow and an adjustable pillow set thereof to support a user's head and neck. In a preferred embodiment, the multi-position cervical pillow comprises a rectangular memory foam pad, the transversal cross section of which is bone-shaped with two lobes protruded towards two opposite lateral ends and a shallow trough in between forming a concave head support portion on each of the two support surfaces; said two lobes are different in size and asymmetrical in shape. By inverting and reversing the pillow pad it provides four unique positions. An adjustable pillow set comprises a main multi-position cervical pillow and an unattached ancillary pillow, the upper surface of the latter has a transversally convex, asymmetrical curvature for the main pillow to stack and slide on top of it, forming four stacking configurations, with each providing two unique positions.

15 Claims, 3 Drawing Sheets

MULTI-POSITION CERVICAL PILLOW AND AN ADJUSTABLE PILLOW SET THEREOF

FIELD OF THE INVENTION

The present invention pertains to a multi-position cervical pillow and an adjustable pillow set thereof to support a user's head and neck during sleep. More specifically, this invention relates to a pillow set which enables the user to vary its elevation, inclination, and cervical curvature.

BACKGROUND OF THE INVENTION

Pre-shaped cervical pillows have been in existence for decades. It started as a therapeutic tool for orthopedic patients, and slowly expanded into consumer market particularly after the visco-elastic memory foam being commercialized. However, decades later, its popularity among average consumers is still limited. The current cervical pillows on the consumer market take a universal single pillow pad construction with two most popular configurations. In one configuration, the pillow has a flat bottom surface, while its upper surface has two lobes protruded upwards, differing in radius/height, disposed along the two longitudinal sides with a trough in between. The lobes are intended to support the neck, whereas the trough is to support the head of a user. In another configuration, the bottom surface of the pillow images its upper surface, so that the pillow is peanut-shaped in its side view. By inverting the pillow pad to switch its longitudinal sides, either configuration provides two positions with two different contoured curvatures/heights for a user to choose from regardless the fact that an optimal alignment of a user's head, neck, and shoulder during sleep varies depending on the user's body size and sleeping position, and that the variations in body size among population and between genders are quite significant. This "two-sizes-fit-for-all" approach certainly has not helped to encourage consumers to embrace the cervical pillows having been on the consumer market so far.

Prior art in adjusting pre-shaped or flat foam pillows in elevation, inclination, cervical support, and firmness of head support surface to fit users with different sleeping positions and different body sizes exists:

U.S. Pat. No. 3,775,785 is directed to an adjustable pillow apparatus having a pair of pillow sections with each having a wedge shaped portion to which removable attachment means is attached so that the pillow sections can be adjusted along their wedge shaped portions to vary the height of the pillow.

U.S. Pat. No. 4,756,090 is directed to an orthopedic pillow having a block made of deformable material, the block having a substantially quadrilateral perimeter, an upper surface of the block having a substantially airfoil-shaped reverse curved surface; and a sizing kit with ordered multiplicity of members for determining an appropriate size of orthopedic pillow for use by a patient.

U.S. Pat. No. 5,537,703 is directed to a multi-position pillow, the construction of which includes a first main face having an essentially planar main surface with a head receiving recess; and a second main surface located opposite the first main face with a plurality of extending fingers arranged in rows. Several recesses are defined in the area between a finger and the surrounding, adjacent fingers of the second main face. The first surface of the pillow provides a relatively firm support, while the second surface of the pillow is convoluted to provide relatively soft support.

U.S. Pat. No. 5,926,879 is directed to a cervical pillow with an insert and lobe of sufficient curvature to enable the user to obtain the intended firmness effects. Formed within the lobe is an opening which has an insert shaped and dimensioned for snug contact therein. The pillow may be reversible and placed on top of a mating pillow wedge positioned between the trough formed between the lobes to provide support for a user when reading, watching T.V., or participating in other activities.

U.S. Pat. No. 6,327,725 is directed to an orthopedic pillow, the body of which is comprised of pre-formed visco-elastic foam with an interior longitudinal cavity disposed near the edge of the pillow on which a user's neck is intended to rest. An inflatable airtight chamber is disposed within the cavity for providing adjustable support to the user's neck. The level of neck support can be adjusted using a hand-operated pump.

U.S. Pat. No. 4,914,763, No. 5,016,303, No. 5,163,194, No. 5,732,427, No. 5,926,880, No. 5,937,460, No. 6,006,380, No. 6,151,733, No. 6,345,401, No. 6,981,288, and No. 7,013,512 are directed to a type of adjustable foam pillows having a construction of multiple removable/changeable components. The adjustment, mostly in heights either for the whole pillow or for the head or neck support area, can be achieved by inserting or removing selected component(s) to customize the pillow for a user.

In addition, U.S. Pat. No. 4,914,763, No. 5,953,777, No. 5,987,676, and No. 6,895,619 are directed to another type of adjustable foam pillows having a plurality of components (or a single component that can be folded into multi-layers) with generally large flat supporting surfaces. A pillow can be constructed by stacking a selected number or type of these components (or folding into certain layers) to adjust the height of the whole pillow or the firmness of its support surface to fit for a particular user and his/her sleeping position.

The prior art described above teaches a variety of cervical foam pillow devices with various methods of customizing a pillow device for a particular user, each with its unique virtue and accompanied with its own limitations. In general, pillow devices having desirable adjustability and adjustable features contain multiple components, usually more than two, and are relatively cumbersome to dispose and adjust. On the other hand, pillow devices with simple construction and relatively easy to adjust usually have limited adjustability in positions and/or adjustable features.

BRIEF SUMMARY OF THE INVENTION

The current invention is intended to provide an improved multi-position cervical pillow which alone can provide four unique positions, and a novel pillow set thereof with an additional, unattached ancillary pillow pad. The simple construction of the pillow set with a simple adjusting method from the present invention will give a user easy control and yield virtually unlimited options for the user to customize the pillow set for his/her personal comfort.

Therefore, this invention relates to a contoured cervical pillow to support users' head and neck, including adjustable portions which are responsible relative to each other to change the configuration, dimensions or mode of use.

One object of the present invention is the provision of a multi-position cervical pillow. According to the first broad principle of this invention, a multi-position cervical pillow comprises a rectangular foam pad with two support surfaces on opposite side thereof, the transversal cross section of which includes two lobes protruded towards the two opposite lateral ends with a shallow trough in between forming a concave head support portion on each of said support surface; said two lobes are different in size and asymmetrical in shape with each curvature extending from the trough of one support surface across the longitudinal edge and merging into the trough on the opposite support surface. This multi-position pillow provides four positions for a user to choose from, each with its own unique cervical curvature and with two of them on one longitudinal side being in a higher elevation than the other two positions on the opposite longitudinal side.

Another object of the present invention is the provision of a cervical foam pillow set. According to the second broad principle of this invention, an adjustable foam pillow set comprises a main multi-position cervical pillow and an ancillary pillow primarily for the main pillow to stack on in various configurations. Said ancillary pillow comprises a rectangular foam pad with its upper surface having a general, transversally convex curvature when viewed in elevation. In a preferred embodiment, the shape of said convex curvature is asymmetrical and generally complementary with the concave curvatures on both of said main pillow's support surfaces.

A yet further object of the present invention is the provision of a method for a user to adjust the main cervical pillow and the pillow set in elevation, inclination, cervical curvature, and the firmness of the head support surface for his/her personal comfort during use. According to the third broad principle of this invention, a method of customizing the adjustable pillow set for a particular user is disclosed.

DETAILED DESCRIPTION OF THE INVENTION

A particular preferred embodiment is disclosed for the multi-position cervical pillow and the adjustable pillow set thereof. From the broad principles of the present invention, various substitutions or equivalents can be produced. The preferred embodiment disclosed herein including the detailed specifications given to it does not intend in any way to limit the present invention to the disclosed preferred embodiment in dimensions, shapes, and building materials of each component therein.

Figure 1:
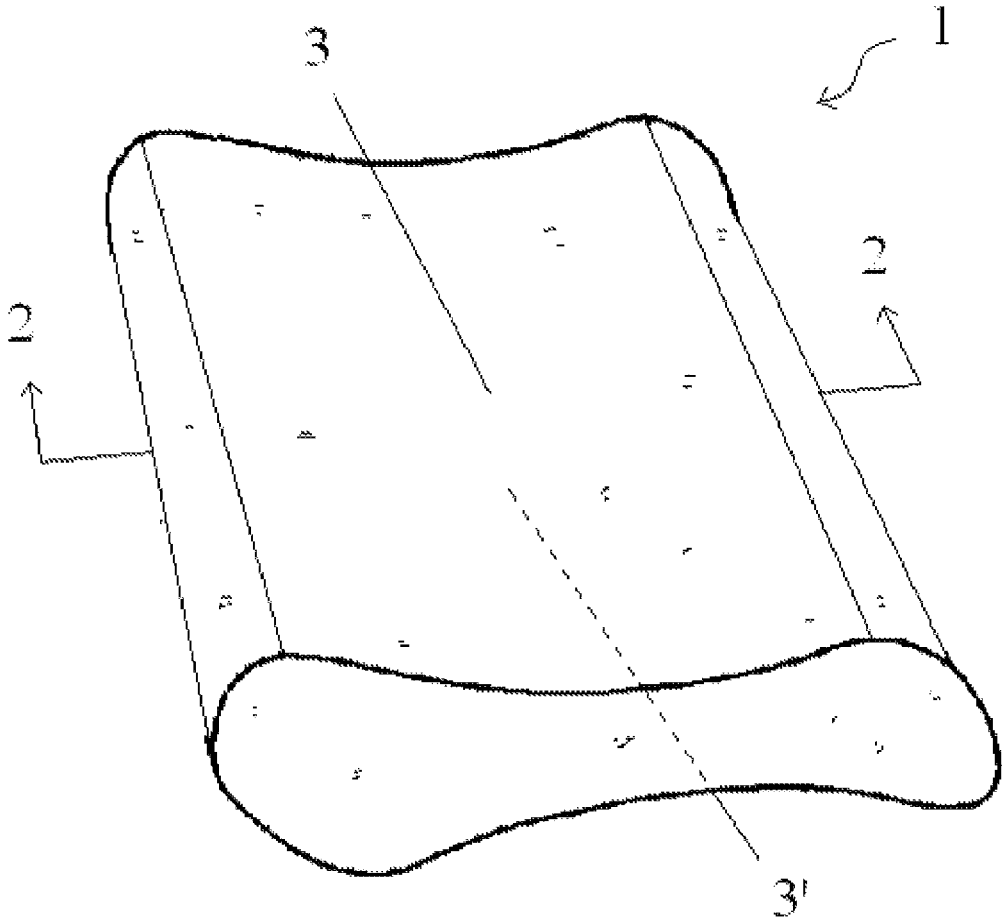
FIG. 1 is a perspective view of a preferred embodiment of the multi-position cervical pillow pad.
Figure 2:
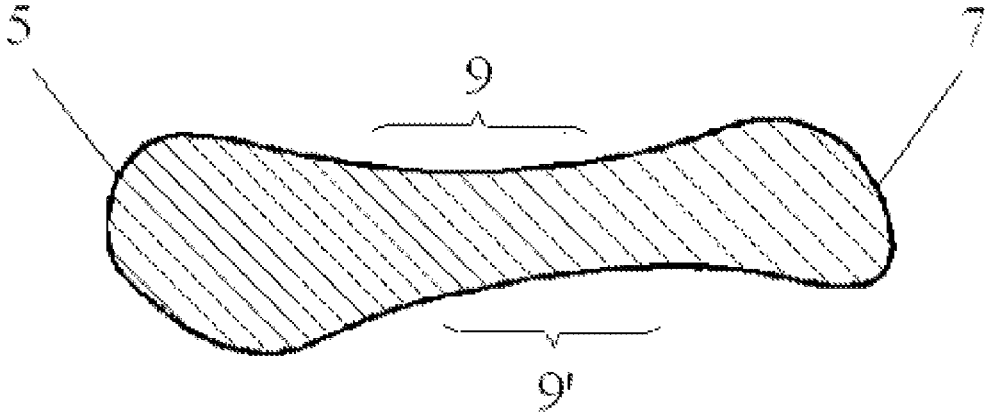
FIG. 2 is a transversal cross-section view of the multi-position cervical pillow pad along the line 2-2 of FIG. 1.

FIGS. 1-2 illustrate the preferred embodiment of the multi-position cervical pillow from the present invention. FIG. 1 is a perspective view, while FIG. 2 a transversal cross-section view of the multi-position cervical pillow pad. The pillow comprises a rectangular pad 1, preferably formed of visco-elastic memory foam, having two support surfaces 3 and 3' on opposing sides. Two lobes 5 and 7, different in size and asymmetrical in shape, are disposed along the two longitudinal edges of the pillow pad with a shallow concave trough in between forming a concave head support portion (9 and 9') on each of support surface. Each longitudinal edge of the pillow is shaped by a lobe's curvature extending from the trough on one support surface across the edge and merging into the trough on the opposite support surface. By inverting the pillow pad to switch the longitudinal sides, each support surface provides two positions for the head and neck support; and by reversing the pillow pad with respect to the support surfaces, another two positions can be provided. Thus, a user has four different positions to choose from with the cervical pillow pad of the present invention, each with its own unique curvature and with two of them on one longitudinal edge in higher elevations than the other two on the opposite longitudinal edge.

Figure 3:
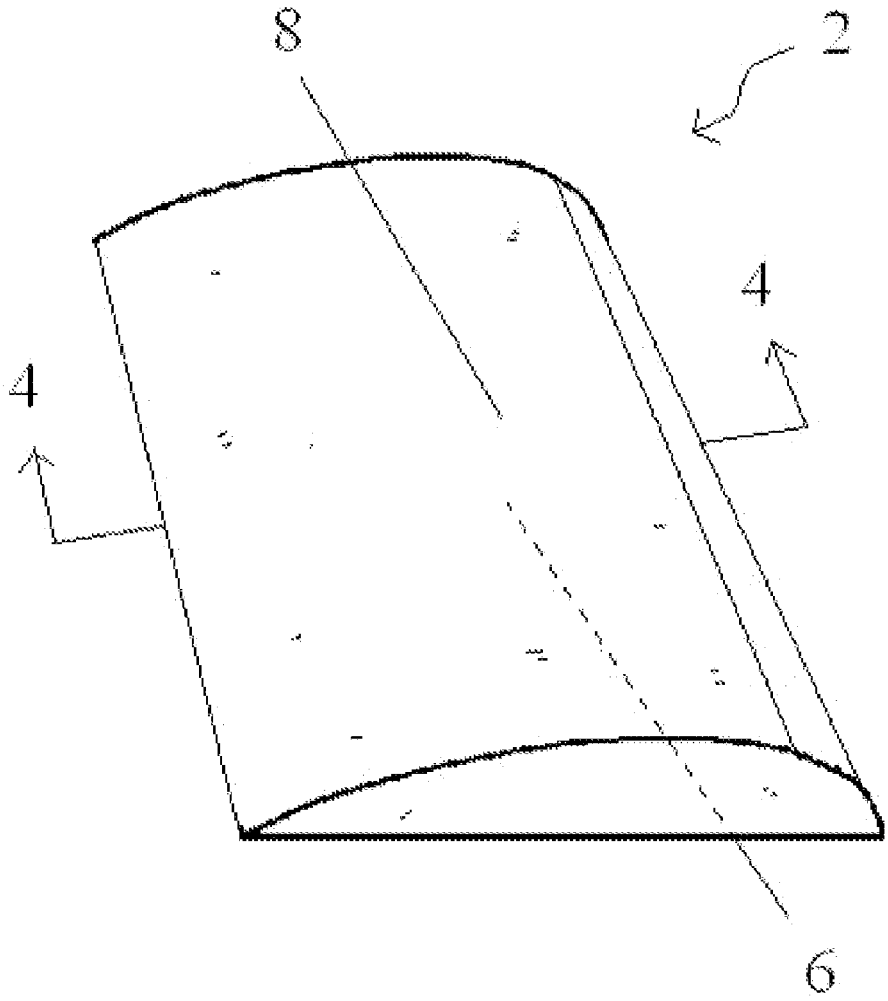
FIG. 3 is a perspective view of a preferred embodiment of the ancillary pillow pad.
Figure 4:
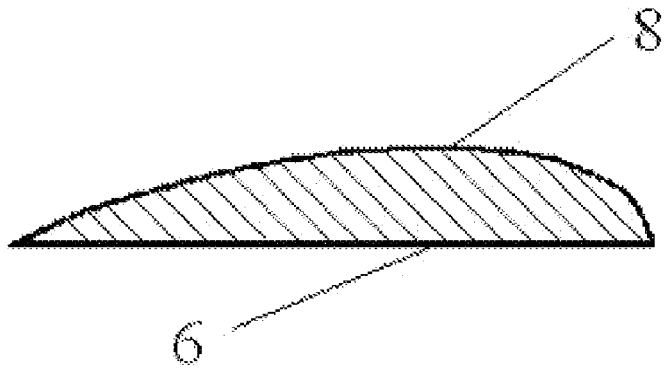
FIG. 4 is a transversal cross-section view of the ancillary foam pillow pad along the line 4-4 of FIG. 3.

In this preferred embodiment, the length of said cervical pillow pad ranges from 45-70 cm, preferably 50-60 cm, and more preferably 55 cm; the width of said pad ranges from 30-55 cm, preferably 30-40 cm and the thickness of said pad at its thinnest trough point ranges from 4-7 cm, preferably 5.5-7 cm;

FIGS. 3-4 illustrate the preferred embodiment of the ancillary pillow pad as a component of the adjustable pillow set from the present invention. FIG. 3 is a perspective view, while FIG. 4 a transversal cross-section view of the ancillary pillow, which comprises a rectangular foam pad 2 with its bottom surface 6 being flat and upper surface 8 having a general, transversally convex curvature. The shape of said curvature is asymmetrical and generally complementary with the concave curvatures on both of the main cervical pillow's support surfaces allowing the main cervical pillow to stack on top of it in various configurations and also to slide over it along its transversal axis to further fine tune a chosen position by a user. The ancillary pillow pad is formed of a foam material, preferably visco-elastic memory foam, and more preferably memory foam with less firmness than that of the main cervical pillow.

In this preferred embodiment, said ancillary pillow pad shares a common length with the main cervical pillow, while its width is preferably about 70%-80%, more preferably 80%, that of the main cervical pillow, with the thickness of the pad at its highest elevation point ranging from 3-7 cm, preferably 3-5 cm.

Figure 5:
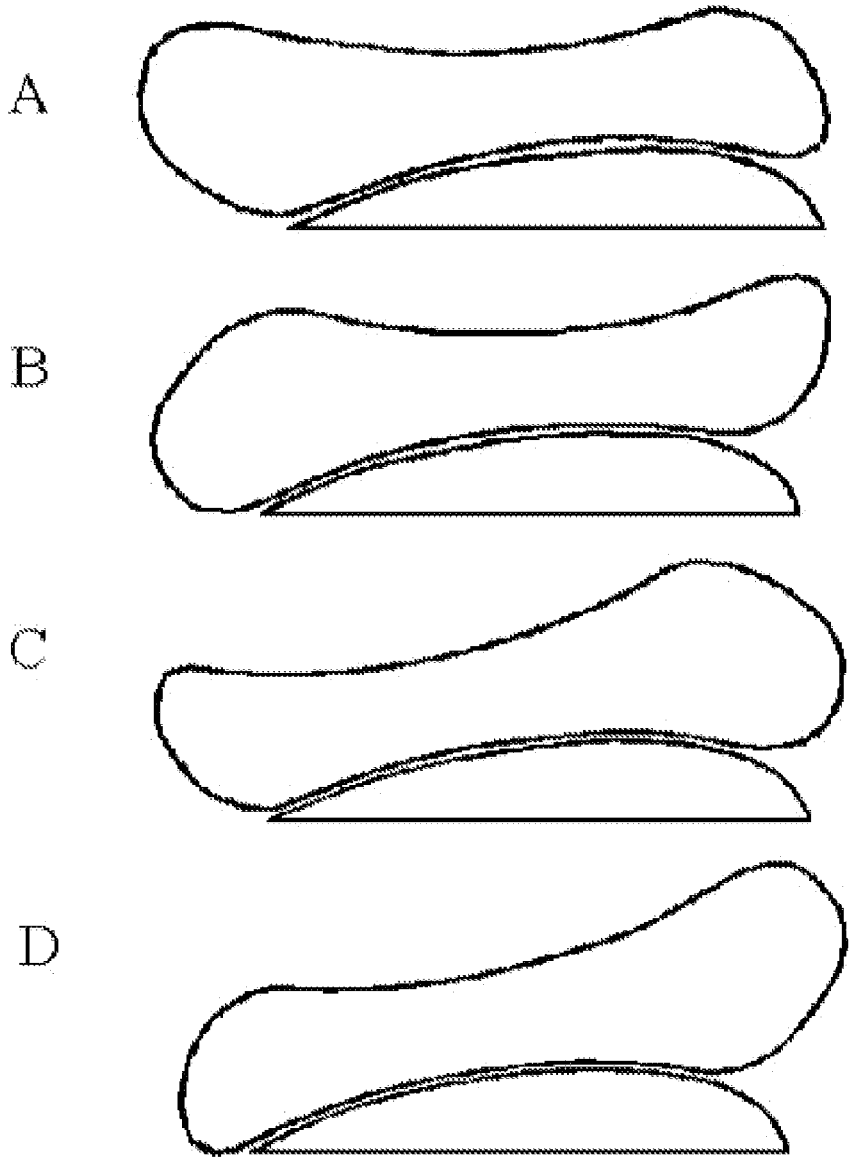
FIG. 5 is a side elevation view of four stacking configurations an adjustable pillow set can make.
Figure 6:
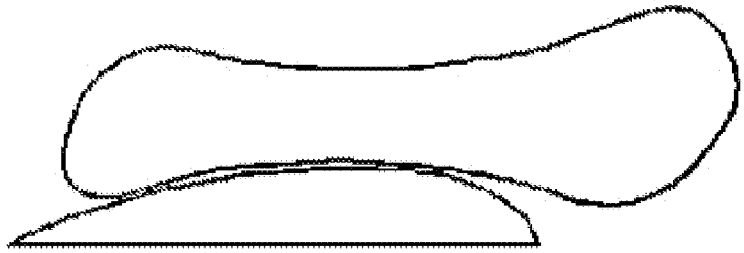
FIG. 6 is an example of adjusting the pillow set position from stacking configuration D of FIG. 5 by sliding the main pillow pad over the ancillary pillow pad along its transversal axis.

FIGS. 5-6 illustrate the method a user can use to make various stacking configurations and fine adjustments from the adjustable pillow set in elevation, inclination, and cervical curvature simply by inverting, reversing, and sliding the main cervical pillow pad on top of the ancillary pillow pad. FIG. 5 is an elevated side view of various stacking configurations an adjustable pillow set from the present invention can make. If the main cervical pillow alone is not high and/or comfortable enough for a user, then a stacking combination with the ancillary pillow can be applied. In this preferred embodiment, the convex curvature on the upper surface of the ancillary pillow is in a shape generally complementary with the concave curvatures on both of the main cervical pillow pad's support surfaces to assure a near-maximum contact surface area between the two stacking pillow pads. By inverting and reversing the main cervical pillow pad on top of the ancillary pillow pad, it can produce four stacking configurations as illustrated in FIG. 5:

A: a randomly picked starting configuration;

B: by reversing the main pillow pad in A;

C: by inverting the main pillow pad in B;

D: by reversing the main pillow pad in C.

Each stacking configuration provides two major head and neck support positions for the pillow set, one on each of its longitudinal side for a user to switch by inverting the whole pillow set. Hence, there are a total of eight major positions for the pillow set to make and for a user to choose from. Due to the asymmetrical nature of the curvature on the top surface of the ancillary pillow, each of the eight major positions has its own unique cervical curvature accompanied with variations in elevation and/or inclination. Furthermore, by sliding the main cervical pillow over the ancillary pillow along its transversal axis, a user can make virtually unlimited choices to fine tune the pillow set for his/her personal comfort.

An example of sliding the main pillow over the ancillary pillow is illustrated in FIG. 6, in which the configuration D of FIG. 5 is further adjusted by sliding the main cervical pillow pad along the transversal axis towards the right end. As a result, both the left and right end positions have changed the elevations, inclinations, as well as the cervical curvatures. To illustrate the sliding effect, FIG. 6 showed a large shift in relative position between the two pillow pads. The adjustment by sliding can be made in much smaller increments yielding virtually unlimited options for a user to fine tune a position.

A method of adjusting the main cervical pillow and the pillow set of the present invention in its elevation, inclination, and cervical curvature by a user comprises the steps of:

1) Selecting or changing a position from the possible four positions on the main cervical pillow for head and neck support by inverting and reversing the main pillow pad;
2) Stacking the main pillow on top of the ancillary pillow;
3) Changing the relative position of the main pillow to the ancillary pillow by sliding the main pillow over the ancillary pillow along the transversal axis;
4) Inverting the ancillary pillow pad alone under the main pillow pad while keeping the main pillow's position relative to the user unchanged;
5) Repeating Step 3;
6) Stopping at any step above when a comfortable position has been found;
7) Going back to any step above till a comfortable position being found.

To change the firmness of the head support surface of this preferred embodiment, a user can simply turn the entire pillow set upside down to use the flat surface on the bottom side of the ancillary pillow pad as the head support surface, preferably with the sharper longitudinal edge of the ancillary pillow pad being adjacent to the user's neck. This simple reconfiguration will create at least four more varieties of positions from the pillow set with a different firmness of the head support surface accompanied with different cervical curvatures and elevations from those described above. Such examples can be visualized simply by inverting FIG. 5.

The ancillary pillow pad alone can also be used by a user as a head support pillow.

In this preferred embodiment, the main and ancillary pillow pads are encased separately. Each case is formed of elastic fabric. The upper surface of the ancillary pillow's case may be decorated with rubber lines or dots to enhance the friction effect of the surface.

In another preferred embodiment of the present invention, there are a plurality of longitudinally parallel, spherical ridges and parallel channels interposed between adjacent of said ridges on the main cervical pillow pad's support surfaces and on the top surface of the ancillary pillow pad so that a selected stacking position can be further "locked" by the mating of the ridges and channels on the contacting surfaces of the two pillow pads.

The invention claimed is:

1. A multi-position cervical pillow for supporting the head and neck of a person, comprising a rectangular foam pad and having two main support surfaces on opposing sides thereof with either side being disposable as a top, the transversal cross-section of which includes two lobes protruded towards two opposing lateral ends with a trough in between, forming a generally concave head-engaging portion on each of said support surface; said two lobes being different in size and asymmetrical in shape with each curvature extending from the trough of one support surface across the longitudinal edge and merging into the trough of the opposite support surface, provides a maximum of four supporting positions for a user to select from by inverting and reversing, while in the absence of introducing any substance or moving any component into or from, said pillow pad, with each position being unique in curvature and with two of the four supporting positions on one longitudinal side having higher elevations than the other two on the opposite longitudinal side.

2. A multi-position cervical pillow of claim 1, wherein said pillow pad is formed of open-cell visco-elastic foam.

3. An adjustable cervical foam pillow set comprising:

1) A main multi-position foam pillow for supporting the head and neck of a person, comprising a rectangular visco-elastic foam pad and having two main support surfaces on opposing sides thereof, the cross-section of which includes two lobes protruded towards the two opposite lateral ends and a trough in between, forming a concave head engaging portion on each of said support surface; said two lobes being different in size and asymmetrical in shape with each curvature extending from the trough of one support surface across the longitudinal edge and merging into the trough of the opposite support surface, enabling said pillow pad to provide a maximum of four unique head and neck support positions for a user to choose from by inverting and reversing said pillow pad;
2) An unattached ancillary pillow primarily for the main pillow to be stacked on top of, having a rectangular foam pad with a similar length as said main pillow; the upper surface of said ancillary pad has a general, transversally convex curvature when viewed in elevation.

4. An adjustable cervical foam pillow set of claim 3, wherein said ancillary pillow's said transversally convex curvature on its upper surface is asymmetrical and in a shape generally complementary with the concave curvatures on both of the main pillow's support surfaces.

5. An adjustable cervical foam pillow set of claim 3, wherein both longitudinal sides of said ancillary pillow pad have sharp or relatively thin edges, and with one edge being sharper or thinner than the other.

6. An adjustable cervical foam pillow set of claim 3 wherein said ancillary pillow is formed of closed-cell resilient foam material.

7. An adjustable cervical foam pillow set of claim 3 wherein said ancillary pillow is formed of open-cell visco-elastic foam.

8. An adjustable cervical foam pillow set of claim 7 wherein said ancillary pillow is formed of foam with different firmness from that of said main pillow.

9. An adjustable cervical foam pillow set of claim 7 wherein said ancillary pillow is formed of foam with the same firmness as that of said main pillow.

10. An adjustable cervical foam pillow set of claim 3, wherein said ancillary pillow's said transversally convex curvature on the upper surface is asymmetrical in shape.

11. An adjustable cervical foam pillow set of claim 3, wherein said ancillary pillow's said transversally convex curvature on the upper surface is in a shape generally complementary with at least one of the concave curvatures that are on both of the main pillow pad's support surfaces.

12. An adjustable cervical foam pillow set of claim 3, wherein said ancillary pillow's transversal width is similar to or shorter than that of said main pillow.

13. A method of adjusting a cervical foam pillow set, which contains a main pillow pad and an unattached ancillary pillow pad, in its elevation, inclination, cervical curvature by a user during use for alignment of his/her head, neck, and shoulders, comprising the steps of:

1) selecting a position on the main pillow pad for head and neck support by inverting and reversing said pad, which provides a maximum of four unique head and neck support positions for a user to choose from;
2) stacking the main pillow pad on top of the ancillary pillow pad, the upper surface of the latter having an asymmetrical, transversally convex curvature, enabling each stacking configuration of the pillow set to provide at least two unique stacking positions for head and neck support, at least one on each longitudinal side of said stacked pillow set for a user to choose from;
3) inverting and reversing the main cervical pillow pad on top of the ancillary pillow pad to make a maximum of four stacking configurations from the stacked pillow set for a user to choose from;
4) sliding the main pillow over the ancillary pillow along the transversal axis to change the relative position of the two stacked pillow pads, which allows a user to produce numerous more different stacking positions from a selected stacking configuration to adjust the stacked pillow set for his/her comfort;
5) stopping at any step above when a comfortable position has been found;
6) repeating any step above till a comfortable position being found.

14. The method of claim 13, comprising the further step of: turning the entire pillow set upside down to use the bottom surface of said ancillary pillow pad as a user's head support surface.

15. The method of claim 13, wherein said steps 1-4 can be performed and repeated by a user with or without a particular sequential order till a comfortable position being found.

* * * * *